US006331816B1

(12) United States Patent
Myllymäki

(10) Patent No.: US 6,331,816 B1
(45) Date of Patent: Dec. 18, 2001

(54) AUTOMATIC CONTROL SYSTEM FOR SECURITY APPARATUS BASED ON THE PRESENCE OF A USER

(75) Inventor: Matti Myllymäki, Espoo (FI)

(73) Assignee: IST International Security Technology Oy, Helsinki (FI)

( * ) Notice: Subject to any disclaimer, the term of this patent is extended or adjusted under 35 U.S.C. 154(b) by 0 days.

(21) Appl. No.: 09/647,968

(22) PCT Filed: Apr. 9, 1998

(86) PCT No.: PCT/FI98/00314

§ 371 Date: Nov. 6, 2000

§ 102(e) Date: Nov. 6, 2000

(87) PCT Pub. No.: WO99/53456

PCT Pub. Date: Oct. 21, 1999

(51) Int. Cl.[7] ..... G08B 21/00

(52) U.S. Cl. ..... 340/540; 340/541; 340/545.1; 340/565

(58) Field of Search ..... 340/540, 541, 340/539, 545.1, 545.3, 565, 566, 573.4, 825.49

(56) References Cited

U.S. PATENT DOCUMENTS

| | | | | |
|---|---|---|---|---|
| 3,833,895 | * | 9/1974 | Fecteau | 340/505 |
| 4,090,182 | * | 5/1978 | Young | 340/522 |
| 4,590,460 | | 5/1986 | Abbott et al. | 340/541 |
| 4,853,677 | * | 8/1989 | Yarbrough et al. | 340/544 |
| 5,153,560 | | 10/1992 | Ichikawa | 340/522 |
| 5,426,425 | * | 6/1995 | Conrad et al. | 340/825.49 |
| 5,640,142 | * | 6/1997 | Matatall, Jr. et al. | 340/514 |
| 5,844,489 | * | 12/1998 | Yarnall, Jr. et al. | 340/573 |

FOREIGN PATENT DOCUMENTS

| | | |
|---|---|---|
| 196 02 623 A1 | 7/1997 | (DE) . |
| 0 707 292 A1 | 4/1996 | (EP) . |
| 2 582 429 A1 | 5/1985 | (FR) . |
| 2 228 120 A | 8/1990 | (GB) . |
| 2 259 173 A | 3/1993 | (GB) . |

* cited by examiner

*Primary Examiner*—Jeffery Hofsass
*Assistant Examiner*—Phung T. Nguyen
(74) *Attorney, Agent, or Firm*—Weingarten, Schurgin, Gagnebin & Lebovici LLP

(57) ABSTRACT

An automatic control system for a security apparatus based on the presence of the user and having a portable transmitter for security based information, a receiver for that information and a control unit. The transmitter provides the receiver and control unit with information on the presence of a person. The receiver and control unit is provided with a detector which detects the opening of a door. A processor uses that presence information and the indication of a door being opened to compile information about whether the user is going out or coming in. The receiver and control unit automatically switches on a burglar monitor placed in a monitored space when the receiver and control unit determine that the user has left the monitored space.

8 Claims, 3 Drawing Sheets

AUTOMATIC CONTROL SYSTEM FOR SECURITY APPARATUS BASED ON THE PRESENCE OF A USER

The present invention relates to an automatic control system for a security apparatus, comprising a portable transmitter unit and a receiver unit to be placed in a monitored space and provided with a processor for processing the received data and with control outputs for connecting the security apparatus in a data transmission contact with communication and/or alarm equipment.

Traditionally, the control of personal clearance, property, and health security systems is performed by means of a control keyboard and/or control switches under the self-acting control of a user. Personal clearance is generally carried out by using separate equipment and various clearance passes or cordless transmitters activated by external control. In property-related security systems, a keyboard is used e.g. for switching a burglar surveillance on and off. In health security systems, a control switch is used for controlling e.g. a passivity surveillance by means of a home/away switch. Referring especially to children and the elderly, the above control systems are too sophisticated and cause unnecessary alarms and restrict the use of security equipment. Also, false alarms in alarm systems are most commonly caused by operating errors, regarding both automobile alarms and buildings. In addition, security systems for a building and an automobile require their own operating equipment of the above type. In personal clearance equipment, the service is generally limited to controlling the clearance passes.

An object of the invention is to create an automatic control system for security equipment, wherein a common control apparatus is used for controlling clearance passes, building-, health-, and automobile-related security equipment automatically without the self-acting control of a user. The personal clearance operation also features an automatic locating system.

This object is achieved on the basis of the characterizing features set forth in the appended claim 1.

Another novelty in the control system is that the user is able to control all pieces of equipment by means of a single wrist-held monitoring device, which also enables the monitoring of a physical condition both in a building and outdoors. When connected to a mobile phone, it provides a portable security system.

The invention will now be described in more detail with reference made to the accompanying drawings, in which FIG. 1 shows block diagrams for the basic units in a security apparatus of the invention;

Figure 1:
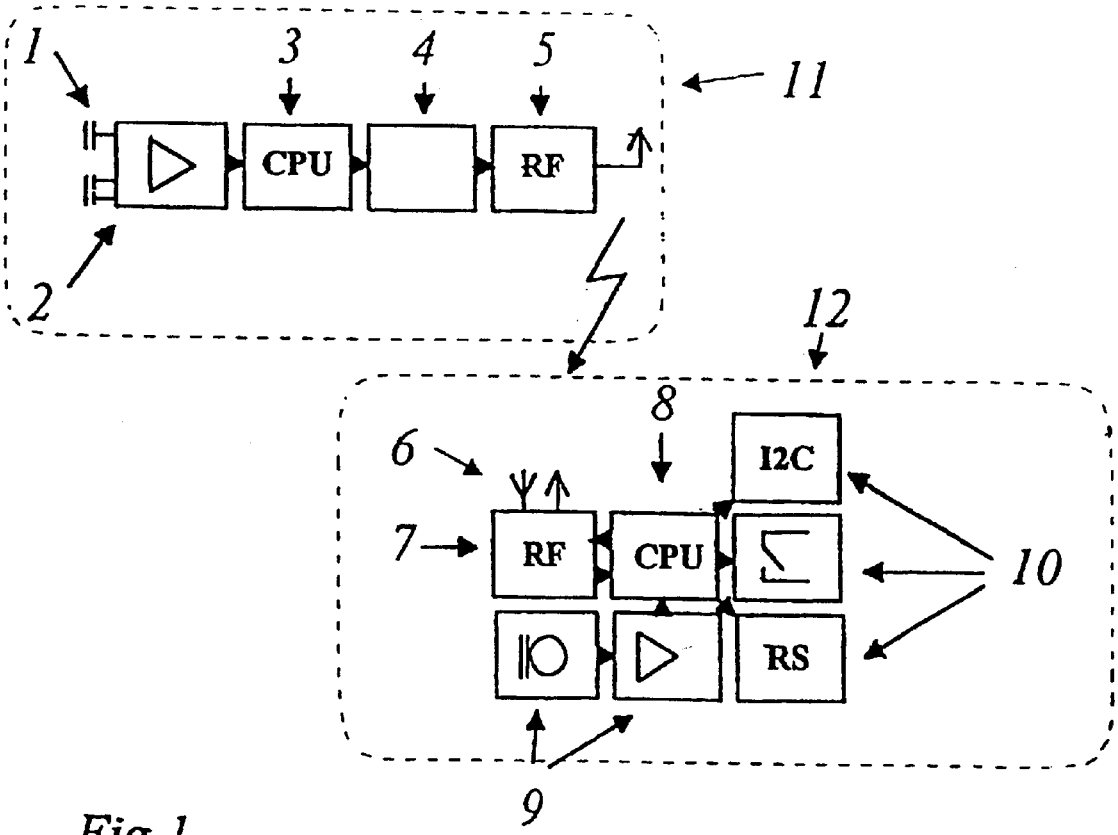

The system of the invention comprises a wrist unit 11 shown in FIG. 1 and a receiver unit 12. Examples of such units are described in the Applicant's patent applications WO 93/16636 (A61B 5/11) and WO 95/07652 (A61B 5/0245). The wrist unit 11 includes an alarm button 1, a contact sensor 2 and a microprocessor 3, a concealing unit 4, as well as a radio transmitter 5, which are designed in conventional technology. Since the unit 11 need not necessarily be a wrist-held device, it can also be termed as a portable transmitter unit. The receiver and control unit 12 also consists of a prior art type of radio receiver 6, a transmitter 7, an infrasound detector 9, a microprocessor 8, and control circuits 10, as well as software. The receiver and control unit 12 includes control outputs to various communication and alarm systems for connecting the same to the standard circuits of the latter. The receiver and control unit 12 can be programmed to include several component units 11 for building a multiple-user control system. The component units 11 of a multiple-user control system can have the ID codes thereof programmed e.g. through a personal clearance system by using a standardized (10/RS) series connection.

The control system bases its operation on messages or telegrams transmitted by the wrist unit 11, which are concealed by prior known methods, e.g. encrypting 4 as well as a device-specific ID code. The transmission gap between telegrams is controlled by a random time, thus resulting in a minor collision risk for telegrams. By means of the above-mentioned telegrams, the receiver and control unit 12 of the control system detects the presence of a user. The infrasound detector 9 detects a low-frequency sound, caused by opening a door. The processor 8 has a software which uses the detector 9 to indicate the opening of a house or automobile door and to compile, together with telegrams transmitted by the wrist unit 11, information about whether the user is going out or coming in. The touch sensor 2 of the wrist unit 11 is used to indicate whether the device is worn around the wrist of a user. Thus, the removal from the wrist switches the wrist unit 11 to a low-current state and the information is sent to the receiver, whereby it can be used as alarm information.

For example, if the user is stepping out of an apartment or an automobile, the infrasound sensor 9 provides information about the opening of a door while the wrist unit 11 is sending telegrams. When telegrams run out as the user leaves the operating range of the transmitter or wrist unit 11, the software of the microprocessor 8 indicates that the user has left the monitored space.

After the above, the software of the processor 8 switches on a burglar monitor 17 and/or provides a clearance pass system with information about the fact that the user has left, the data transmission being performed by using a radio-frequency or permanent connection. This particular function can also be used in security systems for the elderly as a time-dependent activity monitor for an Alzheimer's patient, allowing unlimited activity in daytime, yet producing an alarm e.g. in nighttime.

When the user enters a monitored space, the control system identifies an accepted ID and, if necessary, the opening of a door as well as switches off the burglar monitor and/or provides information about the presence to a clearance control or outpatient security system.

The equipment level of the wrist unit 11 may range from the basic model of FIG. 1 to a model fitted with sensor and software for monitoring a physical condition (see the above-cited international patent applications).

Figure 2:
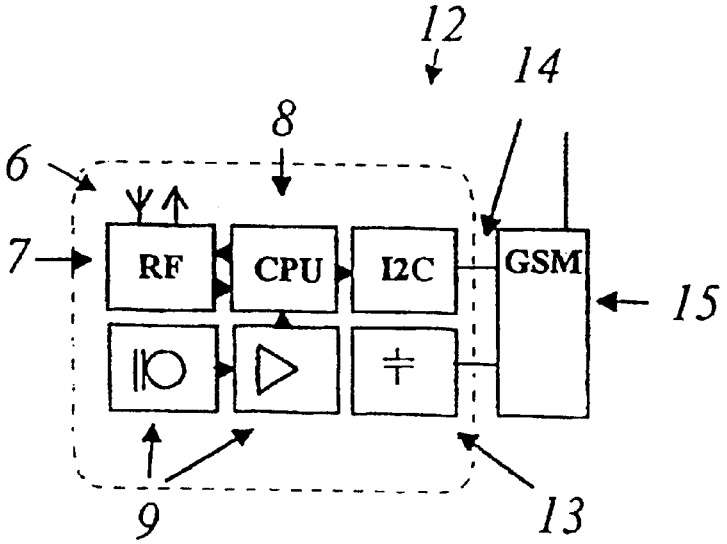
FIG. 2 depicts how a receiver unit included in the apparatus is connected to a mobile phone.
Figure 3:
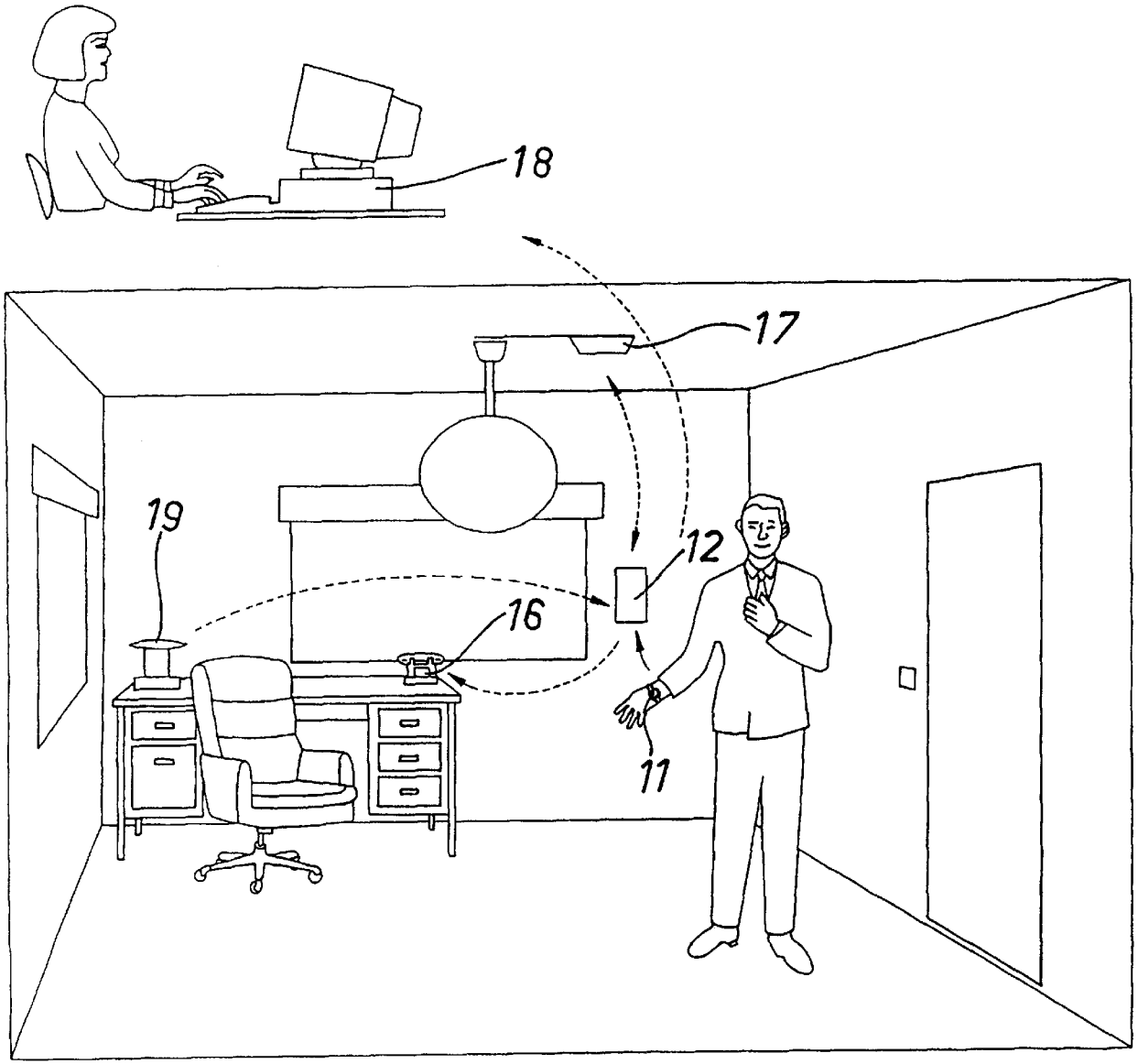
FIG. 3 shows one example of the disposition of various units of the apparatus in an operative situation.
Figure 4:
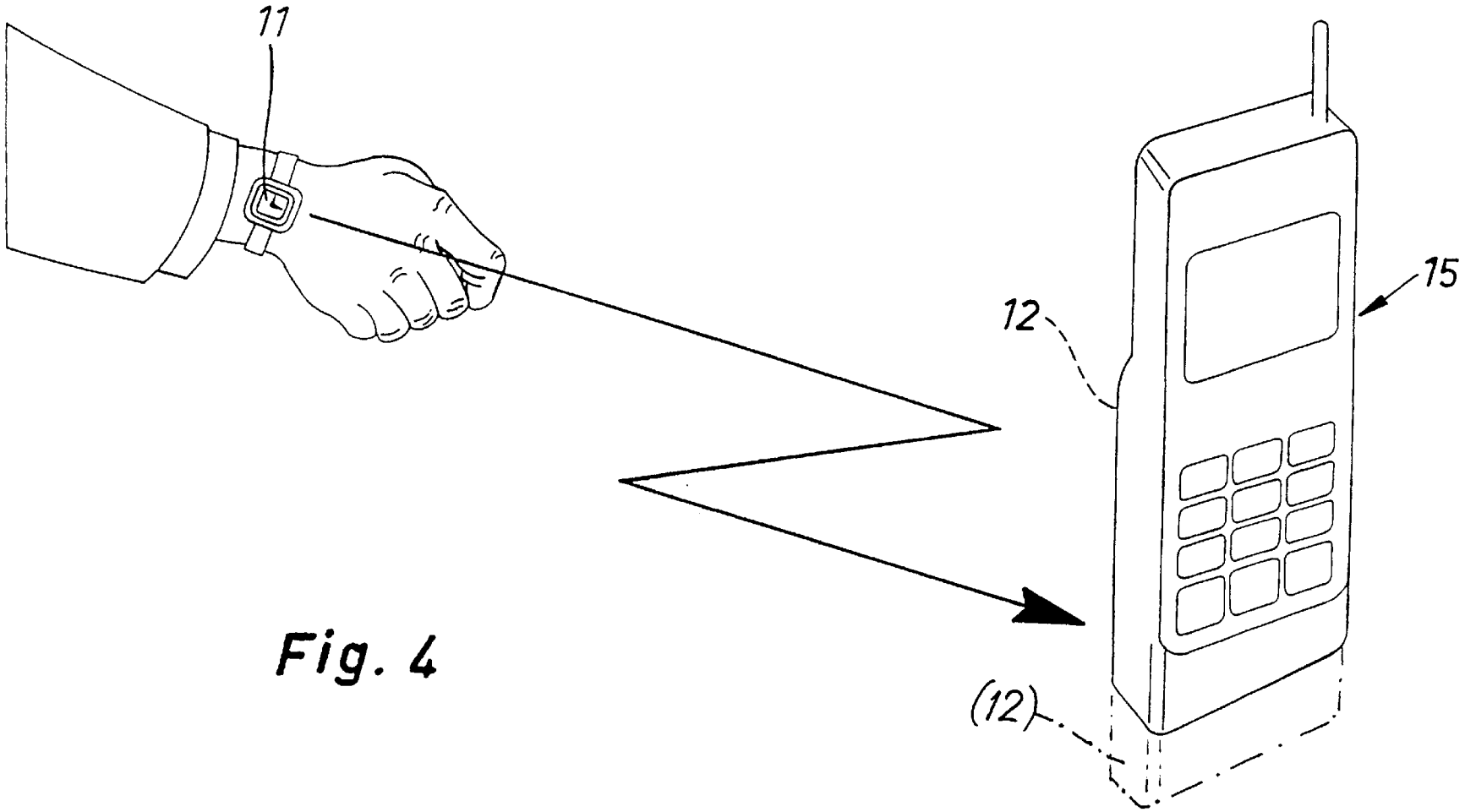
FIG. 4 details the use of the apparatus in connection with a mobile phone.

In connection with a mobile phone (FIGS. 2 and 4), the novel control system provides, together with the wrist unit 11 carrying out the monitoring of a physical condition, a portable security system. The control system can be accommodated in conjunction with the battery case of a mobile phone 15 in such a way that the circuit is constituted by the terminal points in the follow-up memory of batteries 13, whereby the processor of the control system simulates the follow-up memory of a battery as well as conveys the alarm messages to the software of a mobile phone. The automatic control system hooked up with a mobile phone can also be used for transmitting automotive burglary and the like alarms as well as messages necessitated by real-time surveillance through a cellular network to a control facility.

The receiver and control unit 12 can be in communication with a data collection unit (e.g. PC) or with a monitor 18 in a central control room. It may also be connected to a medication dispenser 19 for setting off an alarm if medicines are not taken.

When using an automatic control system of the invention in home, automobile, and office security systems as well as in connection with a mobile phone, the result will be an assembly or unit that can be automatically controlled by means of a single wrist unit. The system operates in such a way that automatic drivers of the invention switch automatically burglar monitoring on and off at various targets, as the user moves from target to target, and, if necessary, disclose information about the location of a user at a given time.

What is claimed is:

1. An automatic control system for a security apparatus, comprising a portable transmitter unit and a receiver and control unit to be placed in a monitored space or target and provided with a processor for processing the received data and with control outputs for connecting the security apparatus in a data transmission contact with communication and/or alarm equipment, characterized in that the transmitter unit supplies the receiver and control unit with messages indicating the presence of a user, that the receiver and control unit is provided with a detector which detects the opening of a door, and that the processor has a software which uses said presence message and the indication of a door being opened to compile information about whether the user is going out or coming in, and that the receiver and control unit automatically switches on a burglar monitor placed in a monitored space, as the receiver and control unit has verified that the user has left the monitored space.

2. A control system as set forth in claim 1, characterized in that the detector is an infrasound detector which detects a low frequency sound created by the opening of a door.

3. A control system as set forth in claim 1, characterized in that the messages from the transmitter unit include a device-specific identification code and the transmitter unit is provided with a message concealing unit.

4. A control system as set forth in claim 1, characterized in that the receiver and control unit is connectable to a mobile phone by using an interface constituted by terminal points in the follow-up memory of batteries.

5. A control system as set forth in claim 1, characterized in that the transmitter unit comprises a device held around the wrist of a user and including an alarm button, a skin contact sensor, a microprocessor, a concealing unit, and a radio transmitter.

6. A control system as set forth in claim 1, characterized in that the receiver and control unit includes a radio receiver for receiving messages from the transmitter unit, a radio transmitter for sending alarm or control messages, an infrasound detector, a microprocessor along with its software, and several control outputs.

7. A control system as set forth in claim 1, characterized in that the transmission gap between messages from the transmitter unit is controlled by a random time.

8. A control system as set forth in claim 3, characterized in that:

the receiver and control unit is connectable to a mobile phone by using an interface constituted by terminal points in the follow-up memory of batteries;

the transmitter unit comprises a device held around the wrist of a user and including an alarm button, a skin contact sensor, a microprocessor, a concealing unit, and a radio transmitter;

the receiver and control unit includes a radio receiver for receiving messages from the transmitter unit, a radio transmitter for sending alarm or control messages, an infrasound detector, a microprocessor along with its software, and several control outputs; and the transmission gap between messages from the transmitter unit is controlled by a random time.

* * * * *